US009983504B2

(12) United States Patent
Makita et al.

(10) Patent No.: US 9,983,504 B2
(45) Date of Patent: May 29, 2018

(54) IMAGE FORMING APPARATUS, DEVELOPING DEVICE, AND DEVELOPING ROLLER SUPPORT DEVICE INCLUDING A DISTANCE REGULATING UNIT

(71) Applicant: FUJI XEROX CO., LTD., Tokyo (JP)

(72) Inventors: Shota Makita, Kanagawa (JP); Shinichi Oba, Kanagawa (JP); Mutsumi Kikuchi, Kanagawa (JP); Nao Kato, Kanagawa (JP); Iori Togu, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days. days.

(21) Appl. No.: 15/437,663

(22) Filed: Feb. 21, 2017

(65) Prior Publication Data

US 2018/0088487 A1 Mar. 29, 2018

(30) Foreign Application Priority Data

Sep. 28, 2016 (JP) ..... 2016-189094

(51) Int. Cl.
*G03G 15/08* (2006.01)

(52) U.S. Cl.
CPC ..... *G03G 15/0812* (2013.01); *G03G 15/0808* (2013.01)

(58) Field of Classification Search
CPC ..... G03G 15/0812; G03G 15/0808
USPC ..... 399/279
See application file for complete search history.

(56) References Cited

U.S. PATENT DOCUMENTS 7,643,774 B2 * 1/2010 Choi ..... G03G 15/0813 399/279
8,041,251 B2 * 10/2011 Nishi et al. ..... G03G 15/0818 399/279

FOREIGN PATENT DOCUMENTS

JP 2005-049499 A 2/2005
JP 2006-330676 A 12/2006

* cited by examiner

*Primary Examiner* — William J Royer
(74) *Attorney, Agent, or Firm* — Sughrue Mion, PLLC

(57) ABSTRACT

Provided is an image forming apparatus including an image carrier on which a latent image is developed, a developing roller that is provided to face the image carrier to perform development for the latent image on the image carrier, an urging unit that urges the image carrier and the developing roller so that the image carrier and the developing roller approach each other, and a distance regulating unit that includes a viscoelastic body that is deformed according to a change of a distance between the image carrier and the developing roller, and regulates at least one of a maximum value of the distance between the image carrier and the developing roller and a minimum value of the distance between the image carrier and the developing roller so that the distance between the image carrier and the developing roller falls within a predetermined range.

20 Claims, 7 Drawing Sheets

IMAGE FORMING APPARATUS, DEVELOPING DEVICE, AND DEVELOPING ROLLER SUPPORT DEVICE INCLUDING A DISTANCE REGULATING UNIT

CROSS-REFERENCE TO RELATED APPLICATIONS

This application is based on and claims priority under 35 USC 119 from Japanese Patent Application No. 2016-189094 filed Sep. 28, 2016.

BACKGROUND

Technical Field

The present invention relates to an image forming apparatus, a developing device, and a developing roller support device.

SUMMARY

According to an aspect of the invention, there is provided an image forming apparatus including:

an image carrier on which a latent image is developed;

a developing roller that is provided to face the image carrier to perform development for the latent image on the image carrier;

an urging unit that urges the image carrier and the developing roller so that the image carrier and the developing roller approach each other; and a distance regulating unit that includes a viscoelastic body that is deformed according to a change of a distance between the image carrier and the developing roller, and regulates at least one of a maximum value of the distance between the image carrier and the developing roller and a minimum value of the distance between the image carrier and the developing roller so that the distance between the image carrier and the developing roller falls within a predetermined range.

BRIEF DESCRIPTION OF THE DRAWINGS

Exemplary embodiments of the present invention will be described in detail based on the following figures, wherein:

FIGS. 4A and 4B are views illustrating an operation of a distance regulating mechanism, in which FIG. 4A is a view illustrating the distance regulating mechanism when a distance between an image carrier and a developing roller is minimized, and FIG. 4B is a view illustrating the distance regulating mechanism when a distance between the image carrier and the developing roller is maximized;

DETAILED DESCRIPTION

Hereinafter, an exemplary embodiment of the present invention will be described in detail with reference to the accompanying drawings.

Figure 1:
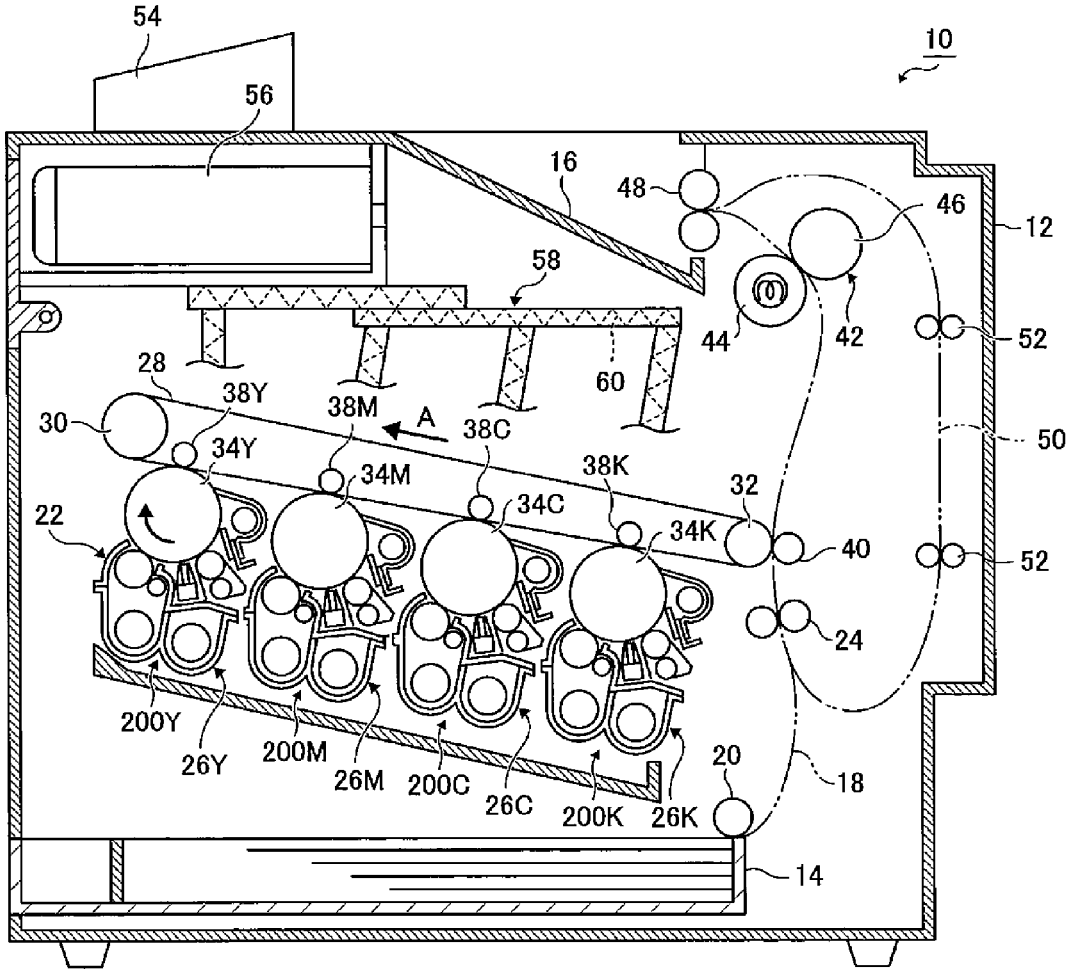
FIG. 1 is a sectional view illustrating an image forming apparatus according to an exemplary embodiment of the present invention, when viewed from the front side.

FIG. 1 is a view illustrating a configuration of an image forming apparatus 10 according to a first exemplary embodiment of the present invention.

The image forming apparatus 10 includes an image forming apparatus body 12. A sheet accommodating unit 14 is provided at a lower portion of the image forming apparatus body 12, and a sheet discharge unit 16 is provided at an upper portion of the image forming apparatus body 12. Plural sheets are accommodated in the sheet accommodating unit 14. A sheet path 18 is formed extending from the sheet accommodating unit 14 to the sheet discharge unit 16.

The sheet placed at the uppermost position of the sheet accommodating unit 14 is fed by a pickup roller 20. The fed sheet is temporarily stopped by registration rollers 24 to be positioned and regulated, and is transported toward a secondary transfer roller 40 to be described later at a predetermined timing.

An image forming unit 22 is provided at the center portion of the image forming apparatus body 12. The image forming unit 22 includes, for example, four image forming units 26Y, 26M, 26C, and 26K. The image forming units 26Y, 26M, 26C, and 26K are provided to correspond to respective colors of yellow (Y), magenta (N), cyan (C), and black (K), and are arranged along an intermediate transfer belt 28 at equal intervals. The intermediate transfer belt 28 is supported by, for example, two support rollers 30 and 32, and rotates in the direction of the arrow A.

The image forming units 26Y, 26M, 26C, and 26K include photoconductor drums 34Y, 34M, 34C, and 34K each of which is an image carrier, and developing devices 200Y, 200M, 200C, and 200K, respectively. The photoconductor drums 34Y, 34M, 34C, and 34K face primary transfer rollers 38Y, 38M, 38C, and 38K across the intermediate transfer belt 28, and developer images formed by the primary transfer rollers 38Y, 38M, 38C, and 38K in the image forming units 26Y, 26M, 26C, and 26K are primarily transferred to the intermediate transfer belt 28.

The secondary transfer roller 40 faces the support roller 32 across the intermediate transfer belt 28. By the secondary transfer roller 40, the primarily transferred developer image is secondarily transferred to the sheet transported through the sheet path 18.

The sheet to which the developer image is secondarily transferred is transported to a fixing device 42. The fixing device 42 is a device that fixes a toner image transferred to the sheet, on the sheet by, for example, heat and pressure, and includes, for example, a heating roller 44 and a pressure roller 46. The sheet on which the developer image is fixed by the fixing device 42 is discharged to the sheet discharge unit 16 by discharge rollers 48.

The image forming apparatus 10 further includes a reverse transport path 50. The reverse transport path 50 is a transport path that reverses a sheet having the developer image formed on one surface thereof, and transports the sheet to the upstream side of the registration rollers 24 in the sheet path 18. For example, two transport rollers 52 are disposed along the reverse transport path 50, and the sheet fed to the reverse transport path 50 from the discharge rollers 48 is transported to the sheet path 18 by the transport rollers 52.

The image forming apparatus 10 further includes a UI device 54. The UI device 54 is provided, for example, on the top of the image forming apparatus body 12. The UI device 54 is configured by combining, for example, a liquid display device and a touch panel-type information input device, and allows an operator to input setting information for image formation or displays information to the operator.

The image forming apparatus 10 further includes developer containers 56 corresponding to the number of the developing devices 200Y, 200M, 200C, and 200K. A developer (toner) is contained in each of the developer containers 56. The developer containers 56 are detachably mounted to the image forming apparatus body 12, for example, in the upper portion of the image forming apparatus body 12.

The image forming apparatus 10 further includes a developer transport device 58. The developer transport device 58 transports developers of respective colors contained in the developer containers 56 to the corresponding developing devices 200Y, 200M, 200C, and 200K. A transport member 60 formed in a spiral shape is provided in the developer transport device 58. When the transport member 60 is rotated, the developers are transported from the developer containers 56 to the developing devices 200Y, 200M, 200C, 200K, respectively.

Figure 2:
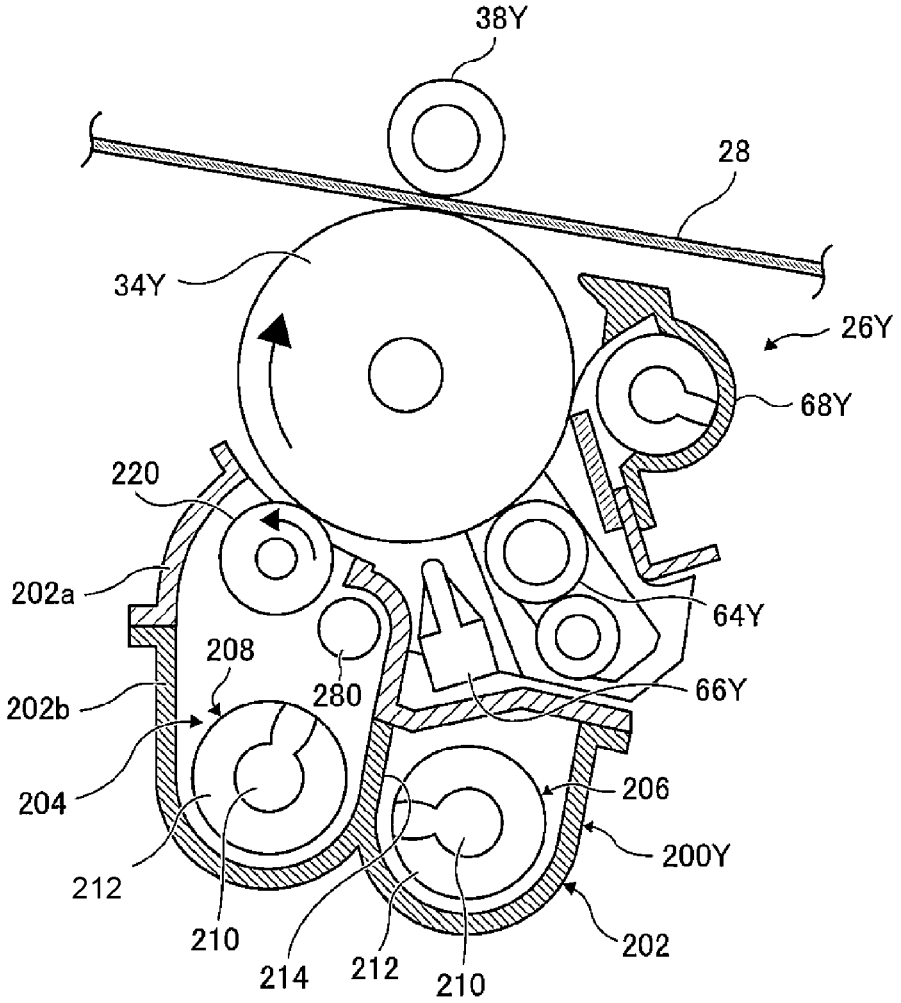
FIG. 2 is a sectional view illustrating an image forming unit used in the exemplary embodiment of the present invention, when viewed from the front side.

In FIG. 2, the image forming unit 26Y for yellow is illustrated as an example of the image forming unit. Meanwhile, configurations of other image forming units 26M, 26C, and 26K are the same as that of the image forming unit 26Y for yellow, and thus descriptions thereof will be omitted.

The image forming unit 26Y includes, in addition to the photoconductor drum 34Y and the developing device 200Y as described above, a charging device 64Y that charges the photoconductor drum 34Y, a latent image forming device 66Y that irradiates the surface of the photoconductor drum 34Y charged by the charging device 64Y with light to forma latent image on the surface of the photoconductor drum 34Y, and a cleaning device 68Y that cleans the photoconductor drum 34Y by removing a toner, or the like remaining on the photoconductor drum 34Y after a toner image is transferred to the intermediate transfer belt 28 by the primary transfer roller 38Y.

The developing device 200Y is a two-component developing device that uses a toner and a carrier for development. The developing device 200Y includes a developing device side casing 202. The developing device side casing 202 is formed by joining an upper member 202*a* to a lower member 202*b*. A developer circulation path 204 is formed at the lower portion of the developing device side casing 202. A first developer transport member 206 and a second developer transport member 208 are disposed in the developer circulation path 204. Each of the first developer transport member 206 and the second developer transport member 208 includes a rotating shaft 210, and a spiral agitation transport unit 212 formed around the rotating shaft 210. The first developer transport member 206 and the second developer transport member 208 are spaced apart from each other by a partition wall portion 214 formed in a central longitudinal direction. Openings (not illustrated) are formed at both sides in the longitudinal direction of the partition wall portion 214. Through the openings, a developer is circulated in the developer circulation path 204.

A developer supply port (not illustrated) is formed at the developing device side casing 202 to be connected to the developer circulation path 204. From the developer supply port, a new toner is supplied through the developer transport device 58 from the developer container 56 as described above.

The developing device 200Y includes a developing roller 220. The developing roller 220 is provided to face the photoconductor drum 34Y to develop the latent image on the photoconductor drum 34Y. A layer thickness regulating member 280 is provided at the upstream side of a developing area facing the photoconductor drum 34Y. The layer thickness regulating member 280 regulates a layer thickness of a magnetic brush formed on the developing roller 220. Then, the developer with a layer thickness regulated by the layer thickness regulating member 280 is supplied to the developing area to form a toner image on the photoconductor drum 34Y.

Figure 3:
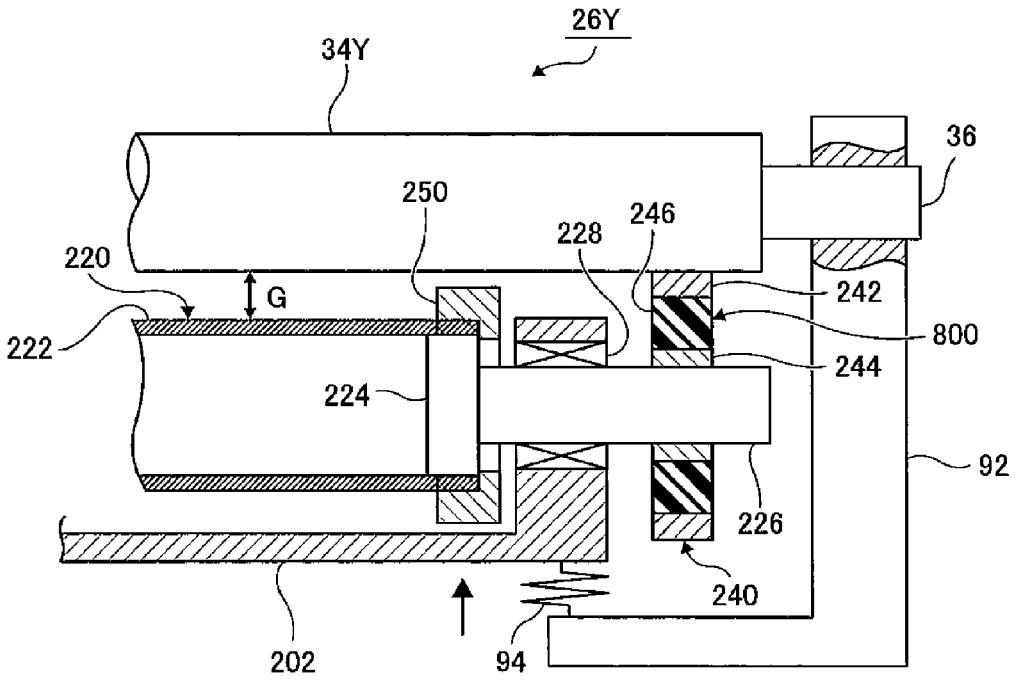
FIG. 3 is a sectional view schematically illustrating a front portion of the image forming unit used in the exemplary embodiment of the present invention, when viewed from the left side.

FIG. 3 is a sectional view schematically illustrating a front portion of the image forming unit 26Y, when viewed from the left side. The image forming unit 26Y is symmetrical in the front-rear direction (the left-right direction in FIG. 3, and the direction intersecting with the sheet surface in FIGS. 1 and 2). The rear-side configuration of the image forming unit 26Y is the same as the front-side configuration of the image forming unit 26Y, and thus descriptions thereof will be omitted.

As illustrated in FIG. 3, the photoconductor drum 34Y includes a drum rotating shaft 36, and is rotatably supported by a photoconductor drum side casing 92 through the drum rotating shaft 36. Here, the photoconductor drum side casing 92 and the above described developing device side casing 202 (see, e.g., FIG. 2) may approach each other or may be separated from each other by, for example, a configuration such as a connection through a hinge (not illustrated).

The above described developing roller 220 includes a cylindrical member 222, and a flange member 224 mounted at the front side of the cylindrical member 222. An outer side (the right end portion side) of the flange member 224 is used as a roller rotating shaft 226, and the roller rotating shaft 226 is rotatably attached to the developing device side casing 202 through a bearing 228.

The image forming unit 26Y further includes a coil spring 94 used as an urging unit. One end portion of the coil spring 94 is mounted to the photoconductor drum side casing 92, and the other end is mounted to the developing device side casing 202 such that the coil spring 94 urges the developing device side casing 202 to the photoconductor drum 34Y side. That is, the coil spring 94 urges such that the photoconductor drum 34Y and the developing roller 220 approach each other.

The image forming unit 26Y further includes a tracking roller 240 as a regulation member. The tracking roller 240 is provided coaxially with the developing roller 220, and is mounted to be rotatable with respect to the roller rotating shaft 226. The tracking roller 240 comes in contact with the photoconductor drum 34Y, thereby regulating a distance between the photoconductor drum 34Y and the developing roller 220. The tracking roller 240 includes an outer ring member 242, an inner ring member 244, and a viscoelastic body 246 (see, e.g., FIG. 5).

The outer ring member 242 has a ring shape and has an outer circumferential surface that comes in contact with the photoconductor drum 34Y.

The inner ring member 244 has a ring shape and rotatably supports the roller rotating shaft 226 (the developing roller 220). More specifically, the inner ring member 244 is made of a resin having a low sliding resistance, and has an inner circumferential surface formed as a sliding surface. The inner circumferential surface rotatably supports the roller rotating shaft 226. The inner ring member 244 is disposed inside the outer ring member 242.

The viscoelastic body 246 is mounted to be sandwiched between the outer ring member 242 and the inner ring member 244. As a specific material of the viscoelastic body 246, for example, a thermoplastic elastomer such as a styrene-based, olefin-based, vinyl chloride-based, urethane-based, or amide-based material may be used, and the viscoelastic body 246 may be made of a material containing any one of polyimide, polyethylene terephthalate, polyoxymethylene resin, and polyacetal resin.

The outer ring member 242 and the inner ring member 244 are made of a resin that is hardly elastically deformed as compared to the viscoelastic body 246. The outer ring member 242, the inner ring member 244, and the viscoelastic body 246 may be integrally molded.

In the tracking roller 240 configured as described above, when one of the outer ring member 242 and the inner ring member 244 is fixed and the other of the outer ring member 242 and the inner ring member 244 is moved, the viscoelastic body 246 is elastically deformed, so that a positional relationship between the outer ring member 242 and the inner ring member 244 is changed.

The image forming unit 26Y further includes a tracking cap 250 as an annular member. The tracking cap 250 has an outer diameter which is larger than the developing roller 220, and smaller than the tracking roller 240. The tracking cap 250 is mounted on the outer circumferential surface of the developing roller 220. The tracking cap 250 may be rotatable with respect to the developing roller 220.

In the image forming unit 26Y configured as described above, the developing device side casing 202, the developing roller 220, the tracking roller 240, and the tracking cap 250 are integrally urged toward the photoconductor drum 34Y side by the coil spring 94 so that the outer ring member 242 of the tracking roller 240 comes in contact with the photoconductor drum 34Y. Then, at a position where the urging force of the coil spring 94, and the repelling force of the viscoelastic body 246 according to the deformation of the viscoelastic body 246 are balanced, the developing device side casing 202, the developing roller 220, the tracking roller 240, and the tracking cap 250 are stopped.

Here, the viscoelastic body 246 is deformed according to a distance between the photoconductor drum 34Y and the developing roller 220. More specifically, when the photoconductor drum 34Y and the developing roller 220 come close to each other, a position occurs where the outer ring member 242 and the inner ring member 244 come close to each other, and the viscoelastic body 246 is deformed to be pressed and crushed at the approaching position. Thus, a change of a distance G between the developing roller 220 and the photoconductor drum 34Y (hereinafter, referred to as a DRS) is absorbed by the deformation of the viscoelastic body 246, and thus a development unevenness caused by the DRS change is suppressed in the exemplary embodiment.

Meanwhile, since the image forming unit 26Y has the viscoelastic body 246, when the viscoelastic body 246 is deteriorated, or is excessively deformed, the DRS may be largely changed, and at least one of a maximum value and a minimum value of the DRS may not fall within a range required for suppressing the density unevenness. Thus, the image forming unit 26Y includes a distance regulating mechanism 800 that regulates the maximum value and the minimum value of the DRS so that the DRS may fall within a predetermined range. Here, the distance regulating mechanism 800 is an example of a distance regulating unit.

Here, the distance regulating mechanism 800 to be described below regulates both the maximum value and the minimum value of the DRS. However, the distance regulating mechanism 800 may regulate at least one of the maximum value and the minimum value of the DRS.

The distance regulating mechanism 800 includes the above described viscoelastic body 246 as a part thereof. That is, the viscoelastic body 246 included in the distance regulating mechanism 800 is provided in the tracking roller 240. The distance regulating mechanism 800 further includes the above described tracking roller 240 and the above described tracking cap 250 as a part thereof.

Figure 4A:
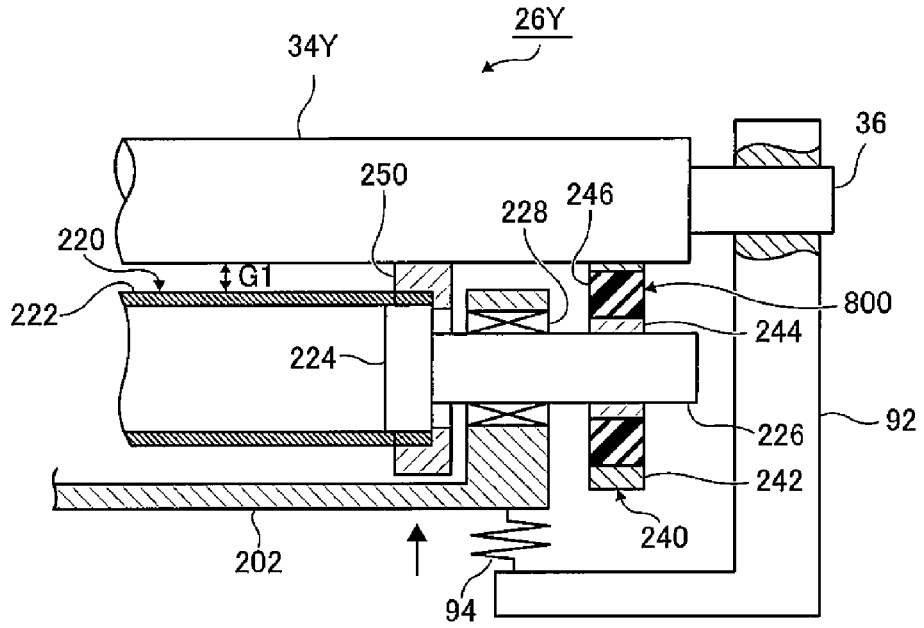
Figure 4B:
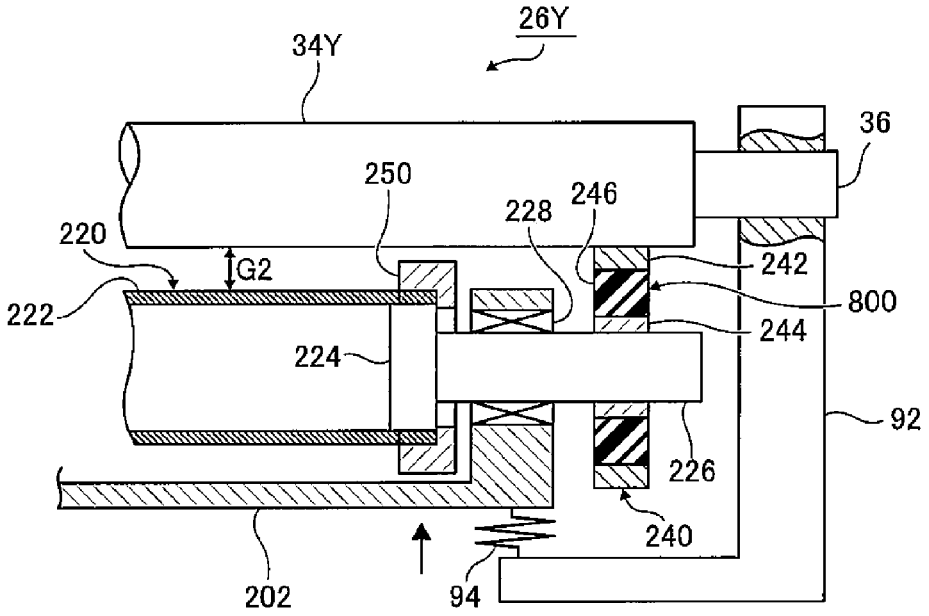

FIGS. 4A and 4B are views for describing an operation of the distance regulating mechanism 800, in which FIG. 4A illustrates the distance regulating mechanism 800 when the DRS is minimized, and FIG. 4B illustrates the distance regulating mechanism 800 when the DRS is maximized.

As illustrated in FIG. 4A, when the outer circumferential surface of the tracking cap 250 comes in contact with the photoconductor drum 34Y, the developing roller 220 may not further approach the photoconductor drum 34Y from this position even by being urged by the coil spring 94. Here, when the upper end portion of the inner ring member 244 in FIG. 4A approaches the photoconductor drum 34Y, the viscoelastic body 246 is pushed by the inner ring member 244 and the outer ring member 242, and deformed to be contracted.

As described above, the distance regulating mechanism 800 brings the tracking cap 250 into contact with the photoconductor drum 34Y to regulate the minimum value of the DRS. Here, G1 in FIG. 4A indicates the minimum value of the DRS.

As described above, the developing roller 220, the tracking roller 240, the developing device side casing 202 and the like are urged in a direction close to the photoconductor drum 34Y by the coil spring 94. Thus, even in a state where the tracking cap 250 is separated from the photoconductor drum 34Y as illustrated in FIG. 4B, the outer ring member 242 of the tracking roller 240 larger in the outer diameter than the tracking cap 250 is pressed against the photoconductor drum 34Y. Then, in this state, the DRS is maximized.

As described above, the distance regulating mechanism 800 allows the outer ring member 242 to be pressed against the photoconductor drum 34Y, thereby regulating the maximum value of the DRS. Here, G2 in FIG. 4B indicates the maximum value of the DRS.

Figure 5:
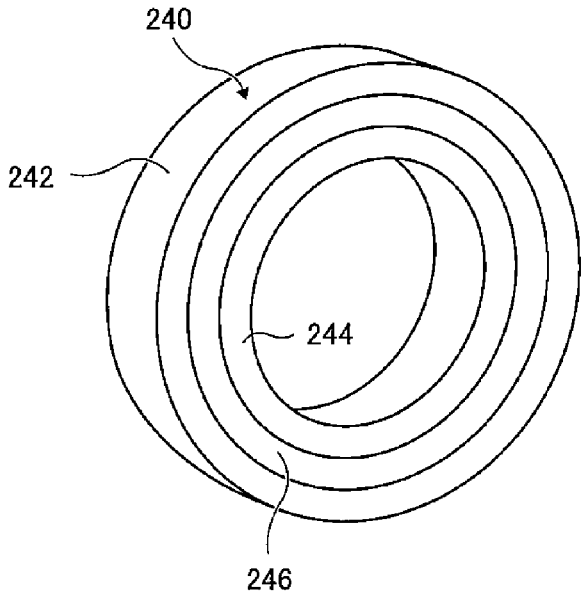
FIG. 5 is a perspective view illustrating a regulation member used in the exemplary embodiment of the present invention.

FIG. 5 is a view illustrating the tracking roller 240. As described above, the tracking roller 240 includes the outer ring member 242, the inner ring member 244, and the viscoelastic body 246.

Figure 6:
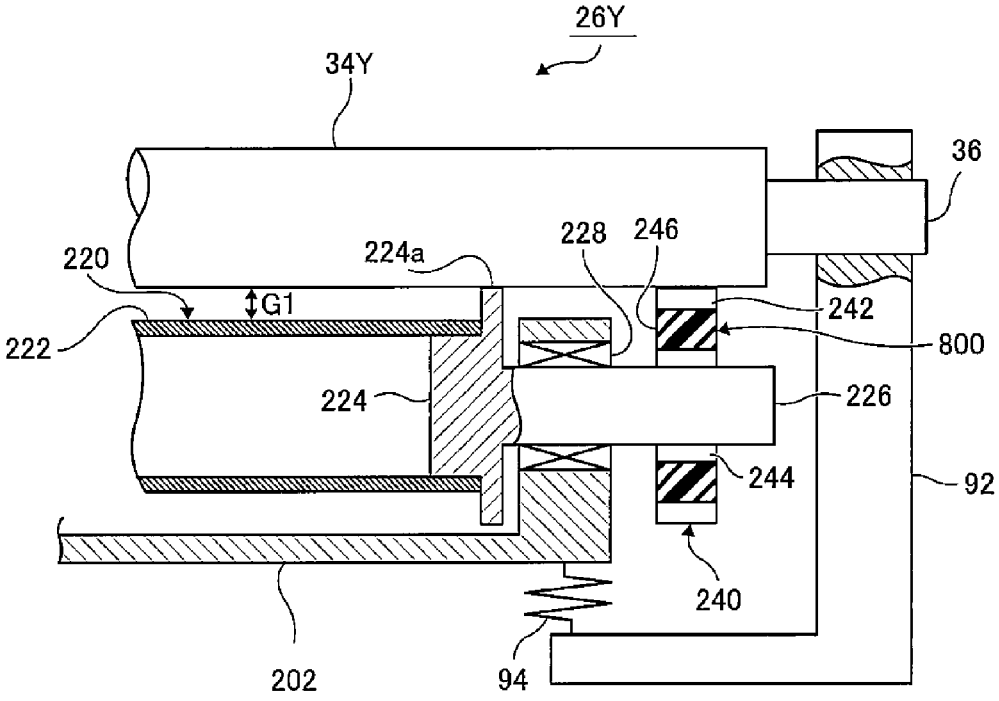
FIG. 6 is a view schematically illustrating a front portion of a first modified example of the image forming unit when viewed from the left side.

FIG. 6 is a view illustrating a first modified example of the image forming unit 26Y. The tracking cap 250 (see, e.g., FIG. 4A) included in the above described exemplary embodiment is not included in the first modified example. In the first modified example, the flange member 224 of the developing roller 220 includes a large-diameter portion 224*a*. The outer diameter of the large-diameter portion 224*a* is larger than the cylindrical member 222 serving as a developer holding portion that holds a developer, and smaller than the tracking roller 240.

In the above described exemplary embodiment, the distance regulating mechanism 800 allows the tracking cap 250 to be pressed against the photoconductor drum 34Y to regulate the minimum value of the DRS. Meanwhile, in the first modified example, the distance regulating mechanism 800 allows the large-diameter portion 224*a* to be pressed against the photoconductor drum 34Y to regulate the minimum value of the DRS.

Figure 7:
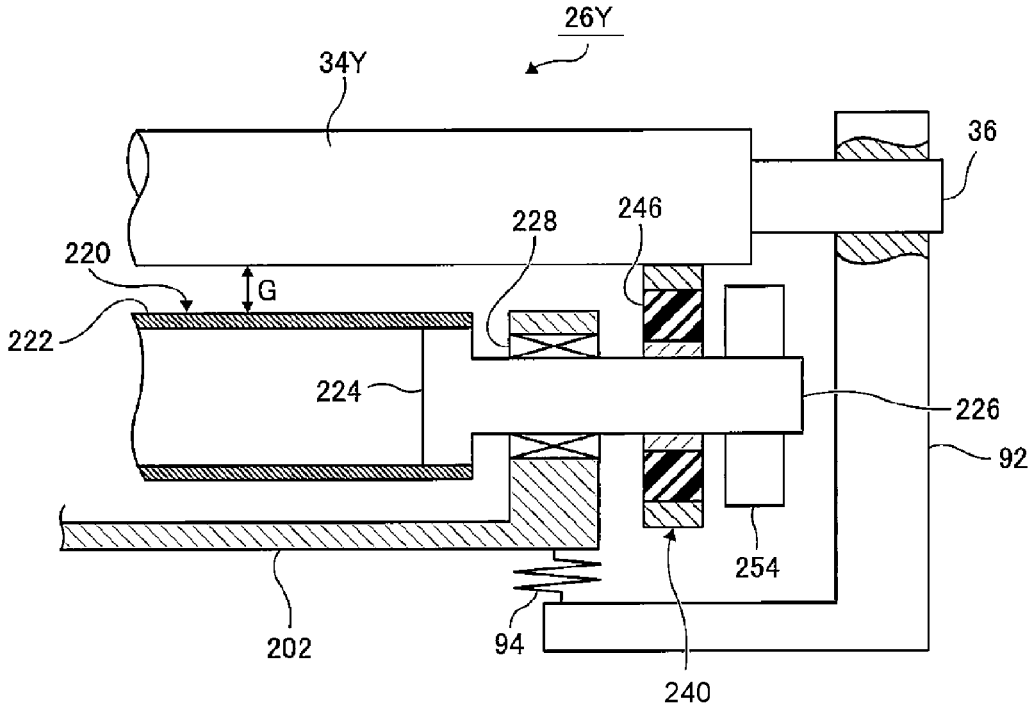
FIG. 7 is a view schematically illustrating a front portion of a second modified example of the image forming unit when viewed from the left side.

FIG. 7 is a view illustrating a second modified example of the image forming unit 26Y. The tracking cap 250 (see, e.g., FIG. 4A) included in the above described exemplary embodiment is not included in the second modified example. The second modified example includes a second tracking roller 254. The second tracking roller 254 is used as an annular member, is provided coaxially with the developing roller 220 and the tracking roller 240, and is mounted to be rotatable with respect to the roller rotating shaft 226. The outer diameter of the second tracking roller 254 is larger than the cylindrical member 222 of the developing roller 220, and smaller than the tracking roller 240.

In the above described exemplary embodiment, the distance regulating mechanism 800 allows the tracking cap 250 to be pressed against the photoconductor drum 34Y to regulate the minimum value of the DRS. Meanwhile, in the second modified example, the distance regulating mechanism 800 allows the second tracking roller 254 to be pressed against the photoconductor drum 34Y to regulate the minimum value of the DRS.

Figure 8:
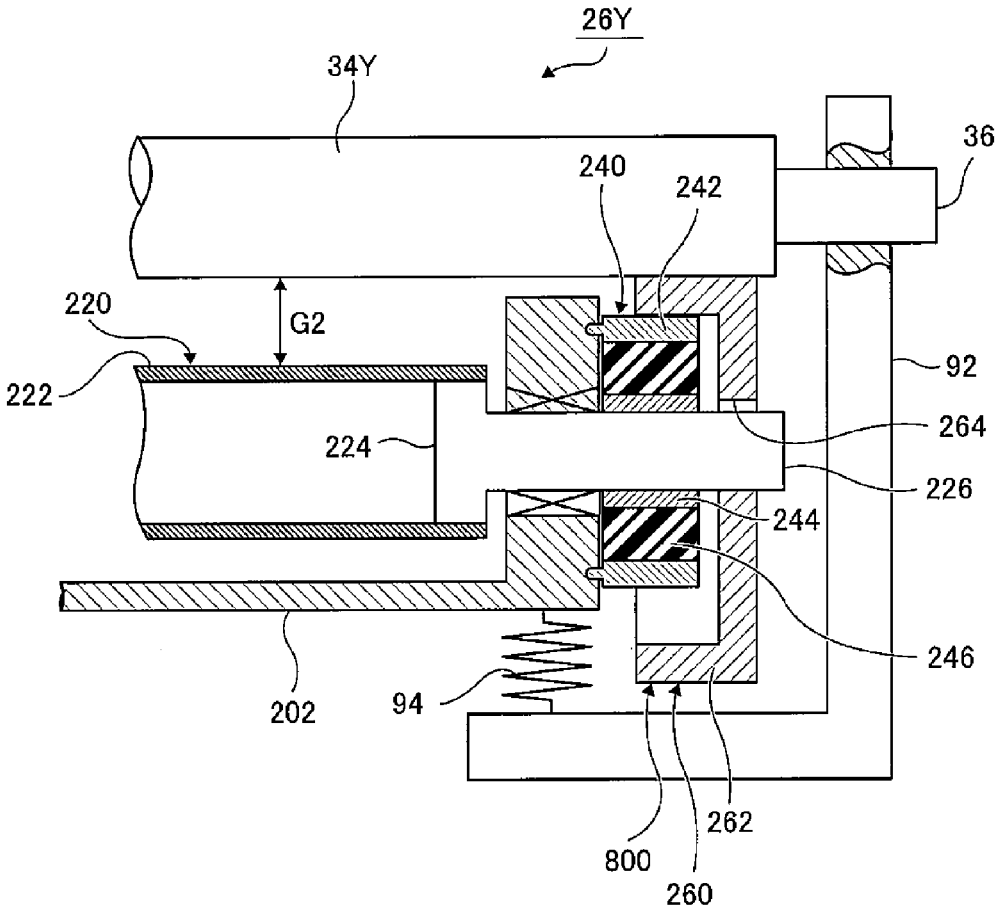
FIG. 8 is a view schematically illustrating a front portion of a third modified example of the image forming unit when viewed from the left side.

FIG. 8 is a view illustrating a third modified example of the image forming unit 26Y. The tracking cap 250 (see, e.g., FIG. 4A) included in the above described exemplary embodiment is not included in the third modified example. In the above described exemplary embodiment, the tracking roller 240 is mounted to be rotatable with respect to the roller rotating shaft 226. Meanwhile, in the third modified example, the tracking roller 240 is fixed to the developing device side casing 202 without rotating, and rotatably supports the roller rotating shaft 226. In the third modified example, the tracking roller 240 is used as a first regulation member.

In the third modified example, the image forming unit 26Y further includes a tracking cap 260. The tracking cap 260 is used as a second regulation member, and includes a cylindrical portion 262 disposed at the outer periphery (outside) of the tracking roller 240. A through hole 264 is formed in the tracking cap 260 through which the roller rotating shaft 226 of the developing roller 220 is inserted, and is movable.

In the above described exemplary embodiment, the distance regulating mechanism 800 allows the outer ring member 242 to be pressed against the photoconductor drum 34Y to regulate the maximum value of the DRS (see, e.g., FIG. 4B). Meanwhile, in the third modified example, while the outer circumferential surface of the tracking roller 240 comes in contact with the inner circumferential surface of the cylindrical portion 262, the outer circumferential surface of the cylindrical portion 262 comes in contact with the photoconductor drum 34Y to regulate the maximum value of the DRS.

In the above described exemplary embodiment, the distance regulating mechanism 800 brings the tracking cap 250 into contact with the photoconductor drum 34Y, thereby regulating the minimum value of the DRS. Meanwhile, in the third modified example, in a state where the viscoelastic body 246 is contracted, the roller rotating shaft 226 of the developing roller 220 comes in contact with the end of the through hole 264 at the photoconductor drum 34Y side to regulate the minimum value of the DRS.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

a developing roller that is provided to face the image carrier and is configured to perform development of a latent image on the image carrier;

an urging unit configured to urge the image carrier and the developing roller so that the image carrier and the developing roller approach each other; and a distance regulating unit that includes a viscoelastic body that is configured to be deformed according to a change of a distance between the image carrier and the developing roller, wherein the distance regulating unit is configured to regulate at least one of a maximum value of the distance between the image carrier and the developing roller and a minimum value of the distance between the image carrier and the developing roller so that the distance between the image carrier and the developing roller falls within a predetermined range.

2. The image forming apparatus according to claim 1, wherein the distance regulating unit is provided coaxially with the developing roller, and includes a regulation member that is configured to contact the image carrier to regulate the distance between the image carrier and the developing roller, and the viscoelastic body is provided in the regulation member.

3. The image forming apparatus according to claim 2, wherein the regulation member includes an outer ring member that is configured to contact the image carrier, and an inner ring member that supports the developing roller and is disposed inside the outer ring member, and the viscoelastic body is provided to be interposed between the outer ring member and the inner ring member.

4. The image forming apparatus according to claim 3, wherein the distance regulating unit is configured to bring the outer ring member into contact with the image carrier to regulate the maximum value of the distance between the image carrier and the developing roller.

5. The image forming apparatus according to claim 4, wherein the distance regulating unit includes an annular member having a diameter larger than a diameter of the developing roller and is provided on an outer circumferential surface of the developing roller, and the distance regulating unit is configured to bring the annular member into contact with the image carrier in a state where the viscoelastic body is contracted to regulate the minimum value of the distance between the image carrier and the developing roller.

6. The image forming apparatus according to claim 4, wherein the developing roller includes a developer holding portion that is configured to hold a developer, and a large-diameter portion that has a diameter larger than a diameter of the developer holding portion, and the distance regulating unit is configured to bring the large-diameter portion into contact with the image carrier in a state where the viscoelastic body is contracted to regulate the minimum value of the distance between the image carrier and the developing roller.

7. The image forming apparatus according to claim 4, wherein the distance regulating unit includes an annular member provided coaxially with the developing roller and the regulation member and having a diameter larger than a diameter of the developing roller and smaller than a diameter of the regulation member, and the distance regulating unit is configured to bring the annular member into contact with the image carrier in a state where the viscoelastic body is contracted to regulate the minimum value of the distance between the image carrier and the developing roller.

8. The image forming apparatus according to claim 3, wherein the distance regulating unit includes an annular member having a diameter larger than a diameter of the developing roller and is provided on an outer circumferential surface of the developing roller, and the distance regulating unit is configured to bring the annular member into contact with the image carrier in a state where the viscoelastic body is contracted to regulate the minimum value of the distance between the image carrier and the developing roller.

9. The image forming apparatus according to claim 3, wherein the developing roller includes a developer holding portion that is configured to hold a developer, and a large-diameter portion that has a diameter larger than a diameter of the developer holding portion, and the distance regulating unit is configured to bring the large-diameter portion into contact with the image carrier in a state where the viscoelastic body is contracted to regulate the minimum value of the distance between the image carrier and the developing roller.

10. The image forming apparatus according to claim 3, wherein the distance regulating unit includes an annular member provided coaxially with the developing roller and the regulation member and having a diameter larger than a diameter of the developing roller and smaller than a diameter of the regulation member, and the distance regulating unit is configured to bring the annular member into contact with the image carrier in a state where the viscoelastic body is contracted to regulate the minimum value of the distance between the image carrier and the developing roller.

11. The image forming apparatus according to claim 3, wherein the viscoelastic body is made of a material containing any one of polyimide, polyethylene terephthalate, polyoxymethylene resin, and polyacetal resin.

12. The image forming apparatus according to claim 2, wherein the distance regulating unit includes an annular member having a diameter larger than a diameter of the developing roller and is provided on an outer circumferential surface of the developing roller, and the distance regulating unit is configured to bring the annular member into contact with the image carrier in a state where the viscoelastic body is contracted to regulate the minimum value of the distance between the image carrier and the developing roller.

13. The image forming apparatus according to claim 2, wherein the developing roller includes a developer holding portion that is configured to hold a developer, and a large-diameter portion that has a diameter larger than a diameter of the developer holding portion, and the distance regulating unit is configured to bring the large-diameter portion into contact with the image carrier in a state where the viscoelastic body is contracted to regulate the minimum value of the distance between the image carrier and the developing roller.

14. The image forming apparatus according to claim 2, wherein the distance regulating unit includes an annular member provided coaxially with the developing roller and the regulation member and having a diameter larger than a diameter of the developing roller and smaller than a diameter of the regulation member, and the distance regulating unit is configured to bring the annular member into contact with the image carrier in a state where the viscoelastic body is contracted to regulate the minimum value of the distance between the image carrier and the developing roller.

15. The image forming apparatus according to claim 2, wherein the viscoelastic body is made of a material containing any one of polyimide, polyethylene terephthalate, polyoxymethylene resin, and polyacetal resin.

16. The image forming apparatus according to claim 1, wherein the distance regulating unit includes:

a first regulation member that includes the viscoelastic body and is provided coaxially with the developing roller not to be rotatable; and a second regulation member that includes a cylindrical portion disposed at an outer periphery of the first regulation member, a through hole being formed in the second regulation member so that a rotating shaft of the developing roller is inserted into the through hole and is movable in the through hole, wherein the distance regulating unit is configured to bring an outer circumferential surface of the first regulation member into contact with an inner circumferential surface of the cylindrical portion, and is configured to bring an outer circumferential surface of the cylindrical portion into contact with the image carrier, to regulate the maximum value of the distance between the image carrier and the developing roller, and the distance regulating unit is configured to bring the rotating shaft of the developing roller into contact with an end of the through hole at the image carrier side in a state where the viscoelastic body is contracted, to regulate the minimum value of the distance between the image carrier and the developing roller.

17. The image forming apparatus according to claim 16, wherein the viscoelastic body is made of a material containing any one of polyimide, polyethylene terephthalate, polyoxymethylene resin, and polyacetal resin.

18. The image forming apparatus according to claim 1, wherein the viscoelastic body is made of a material containing any one of polyimide, polyethylene terephthalate, polyoxymethylene resin, and polyacetal resin.

19. A developing device comprising:

a developing roller that is provided to face an image carrier on which a latent image is developed, and is configured to perform development for the latent image on the image carrier;

an urging unit configured to urge the image carrier and the developing roller so that the image carrier and the developing roller approach each other; and a distance regulating unit that includes a viscoelastic body that is configured to be deformed according to a change of a distance between the image carrier and the developing roller, wherein the distance regulating unit is configured to regulate at least one of a maximum value of the distance between the image carrier and the developing roller and a minimum value of the distance between the image carrier and the developing roller so that the distance between the image carrier and the developing roller falls within a predetermined range.

20. A developing roller support device for regulating at least one of a maximum value of a distance between an image carrier and a developing roller and a minimum value of the distance between the image carrier and the developing roller so that the distance between the image carrier and the developing roller falls within a predetermined range, wherein the developing roller support device comprises:

an outer ring member;

an inner ring member that is provided on the developing roller and is disposed inside the outer ring member; and a viscoelastic body that is provided between the outer ring member and the inner ring member and is configured to be deformed according to a change of a positional relationship between the outer ring member and the inner ring member.

* * * * *